US006050368A

United States Patent [19]

Pakarinen et al.

[11] Patent Number: 6,050,368

[45] Date of Patent: Apr. 18, 2000

[54] PROCEDURE AND APPARATUS FOR CONTROLLING THE HOISTING MOTOR OF AN ELEVATOR

[75] Inventors: Arvo Pakarinen; Jarmo Maenpaa, both of Hyvinkaa, Finland

[73] Assignee: Kone Oy, Helsinki, Finland

[21] Appl. No.: 08/875,447

[22] PCT Filed: Jan. 30, 1996

[86] PCT No.: PCT/FI96/00057

§ 371 Date: Oct. 28, 1997

§ 102(e) Date: Oct. 28, 1997

[87] PCT Pub. No.: WO96/23722

PCT Pub. Date: Aug. 8, 1996

[30] Foreign Application Priority Data

Jan. 31, 1995 [FI] Finland ..... FI950426
Jan. 31, 1995 [FI] Finland ..... FI950427

[51] Int. Cl.[7] ..... B66B 1/28

[52] U.S. Cl. ..... 187/293

[58] Field of Search ..... 187/394, 284, 187/291, 294, 293, 292

[56] References Cited

U.S. PATENT DOCUMENTS

| | | | |
|---|---|---|---|
| 3,526,300 | 9/1970 | Ferrot | 187/293 |
| 4,042,068 | 8/1987 | Ostrander et al. | 187/29 R |
| 4,489,811 | 12/1984 | Yoemoto et al. | 187/294 |
| 4,515,247 | 5/1985 | Caputo | 187/293 |
| 4,776,434 | 10/1988 | Caputo | 187/118 |
| 5,424,498 | 6/1995 | Spielbauer et al. | 187/292 |
| 5,509,505 | 4/1996 | Steger et al. | 187/394 |
| 5,635,688 | 6/1997 | Katesaria et al. | 187/292 |
| 5,686,707 | 11/1997 | Iijima | 187/291 |
| 5,783,784 | 7/1998 | Durand | 187/394 |

FOREIGN PATENT DOCUMENTS 4120544 1/1993 Germany .

*Primary Examiner*—Jonathan Salata

[57] ABSTRACT

In the control of the hoisting motor (5) of an elevator, the output (25,125) of the motor drive is generated using a signal (23,127) proportional to the rotation of the hoisting motor as feedback signal during passages between floors. At or near a landing, the position of the elevator car (1) in relation to the landing (8) is measured using a sensor (10) placed on the elevator car, and the position signal (25,125) is utilized to produce a reference for controlling the hoisting motor.

28 Claims, 4 Drawing Sheets

PROCEDURE AND APPARATUS FOR CONTROLLING THE HOISTING MOTOR OF AN ELEVATOR

FIELD OF THE INVENTION

The present invention relates to a method and apparatus for the control of the hoisting motor of an elevator.

BACKGROUND OF THE INVENTION

Problems are encountered in the speed control of an elevator when the elevator is moving at a low speed while approaching a landing in order to stop or departing from a landing. The start of the movement of the elevator should be soft and free of jerks. In order to enable the elevator car in particular to start moving in a soft and jerk-free manner, the hoisting motor of the elevator is conventionally controlled using a speed reference adjusted for this purpose and a feedback speed controller. The feedback element used is typically a tachometer which measures the speed from the motor shaft, giving a voltage or pulse frequency proportional to the speed. The feedback element conventionally used in the elevator speed controller is a direct voltage tachometer whose output voltage is directly proportional to the rotational speed of the motor, which can be used to determine the vertical speed of the elevator.

Controlling the elevator speed is a problem when the elevator is moving at a low speed while approaching a landing in order to stop or departing from a landing. In the case of geared elevators, the transition from a static friction condition to a condition where kinetic friction prevails is particularly difficult to manage. The elevator car does not always move as one would expect it to when observing the speed of the motor shaft. The elevator guides, especially sliding guides, may be so tight that, to overcome the static friction at the departure of the elevator, a considerable "extra" motor torque is needed, before the motor shaft starts rotating. This also applies to the hoisting machinery, in which the static friction of the bearings has to be overcome.

The internal friction of the bearings and hoisting machinery is especially significant in geared elevators. A situation readily arises where the speed reference, and often also the speed difference, has become fairly large before the static friction is overcome. It is practically impossible to correct any large vibrations of the elevator car if the correction is based on observing the rotation of the motor shaft. When the elevator car finally starts moving, it is not possible to avoid a jerk being felt in the car by detecting the speed of the motor shaft. This is true especially if, due to rope elongation, energy is stored in the elevator ropes and is then discharged as the static friction is changed into kinetic friction that is lower than the static friction. The problem can be regarded as being based on the absence of correct, sufficiently accurate and timely feedback information about the position and/or motional condition of the elevator car.

When the elevator starts moving, there should be a way to reduce the torque in time from the level needed to overcome the static friction to a level corresponding to the motional condition of the car and the kinetic friction of the system, but as there is no direct information available about the speed level of the car other than a motor speed tachometer signal which cannot consider rope elongation data or other differences prevailing in the system between the tachometer data and the actual motional condition of the car, the motor is likely to maintain the torque corresponding to the static friction longer than necessary. In this way, when the car starts moving, the system readily produces a starting jerk which then continues in the form of decreasing oscillation.

To provide a solution to the problem of a starting jerk and oscillation, an accelerometer placed in the car has been proposed. In this case, the acceleration signal obtained from the accelerometer would be converted into a car speed signal, which would further be used to adjust the car speed instead of the motor shaft speed. However, the accelerometer is an expensive and sensitive component and its output signal requires a high class amplifier to produce a reliable signal.

Conventional start adjustment of an elevator involves the use of an electronic weighing device which measures the torque on the motor shaft via brake shoes. The output of the weighing device is passed to a regulator which controls the motor torque in such a way that it cancels the torque resulting from the load, in other words, the torque acting on the weighing device is adjusted to zero. However, this type of start adjustment requires expensive mechanical brake shoe solutions for the machinery, the weighing device elements are susceptible to damage, and the system must be used as before each time an elevator is used. Additionally the weighing device electronics have to be calibrated to adapt them to the particular elevator.

One of the factors causing problems is the absence of sufficiently correct position data when the elevator is moving near a landing at a low speed, i.e. almost 0-speed. While the tachometer signal does give a fairly good speed data resolution even for low speeds, the position data obtained via calculation from the tachometer signal may clearly differ from the actual position of the elevator car.

To meet the needs and solve the problems described above, an apparatus and a procedure for controlling the hoisting motor of an elevator using positional feedback from a linear position sensor to smoothly overcome static friction during acceleration are presented as an invention.

SUMMARY OF THE INVENTION

The advantages achieved by the invention include the following:

- The solution of the invention is easy to implement using modern microprocessor based control systems.
- The starting jerk occurring when the elevator starts moving is eliminated or at least clearly reduced.
- Since the speed controller receives feedback about the position and speed of the car during the whole starting process, e.g. the moment of overcoming the static friction of the sliding guide shoes of the car, i.e. even a slight movement of the car, is detected. This makes it possible to adjust the motor torque in time to a value corresponding to the car speed condition.
- Possible after-oscillation caused by a starting jerk can be eliminated by actively adjusting the motor on the basis of actual information.
- Accurate and fast start adjustment can be achieved without expensive additional electronics.
- The operating brake, whether built in with the motor or implemented as a separate part, need not be provided with weighing device elements, thus also obviating the need for their calibration.
- The invention is well suited for use in levelling.
- At departure from a landing, a correct feedback signal about the elevator movement is obtained quickly.
- Even at low speeds, car speed data can be obtained by calculating from the car position data without the use of expensive additional detectors.
- The invention is applicable in elevator modernization projects, allowing the elevator's performance characteristics regarding arrival at a landing and starting from a landing to be improved in a simple manner.

BRIEF DESCRIPTION OF THE DRAWINGS

In the following, the invention is described by the aid of an application example by referring to the attached drawings, in which.

DETAILED DESCRIPTIONS OF THE DRAWINGS

The linear sensor is a component that gives a current or other signal proportional to the distance between the sensor and a reference point. In the present invention, this signal is utilized in the adjustment of deceleration and start control of the elevator. Using a linear sensor, the position and speed of the elevator car are measured when the elevator is within a given distance window from the landing, and the result is used as a feedback signal in the control of the hoisting motor of the elevator. When the elevator is being prepared for departure and the brake frames are being opened, the position data obtained from the linear sensor can be used to control the hoisting motor so that it will keep the elevator car immobile until the brake is released and the elevator starts running according to control. An applicable preferred linear sensor is the VAC VACUUMSCHMELZE T60500-X5810-X010-51 type sensor, which provides a linear signal proportional to the position of the sensor relative to a magnet acting as a position reference point over a travelling distance of 150 mm.

Figure 1:
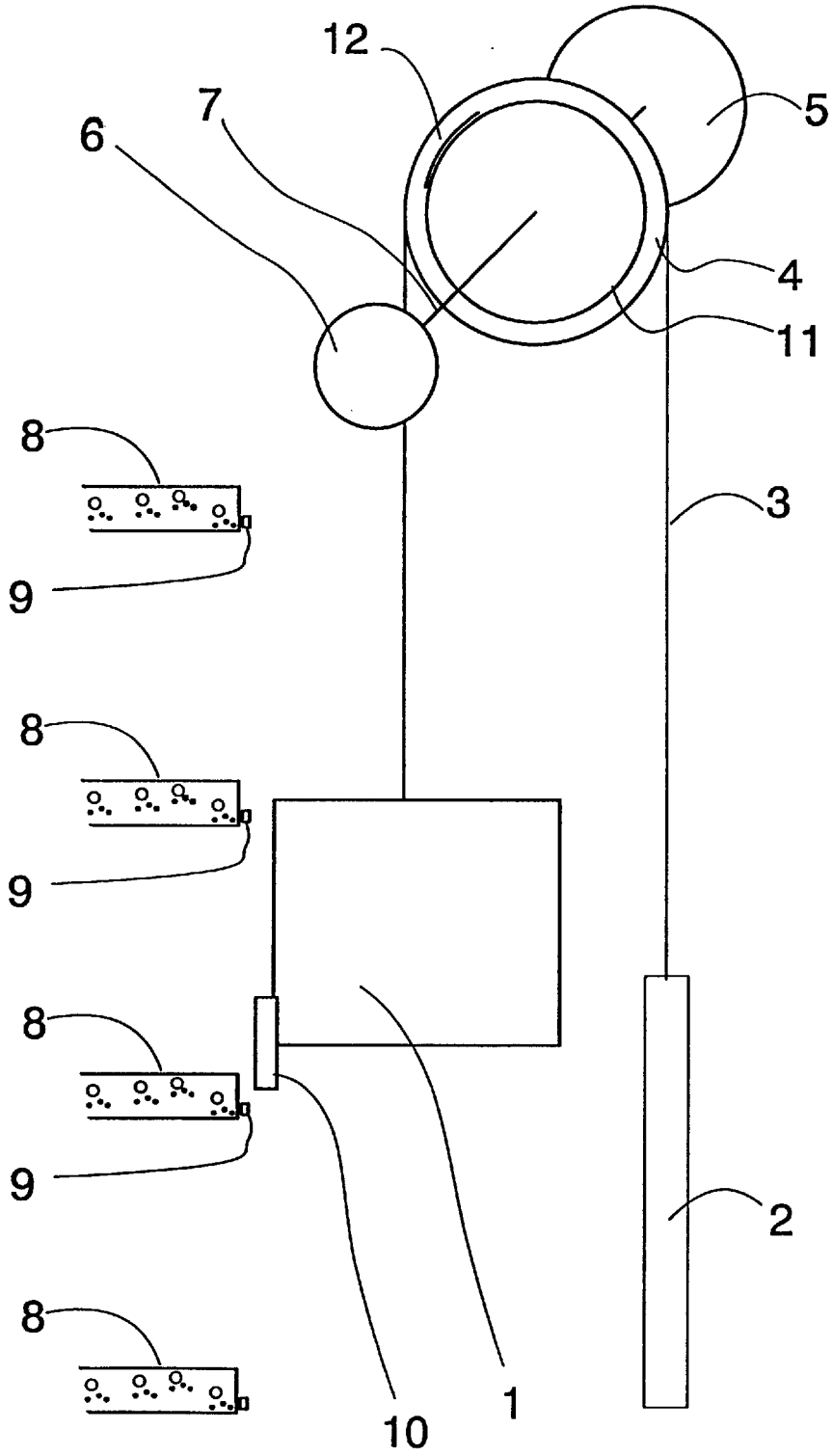
FIG. 1 presents a diagram of an elevator applying the invention.

FIG. 1 is a diagrammatic representation of an elevator. Suspended on hoisting ropes 3 are an elevator car 1 and a counterweight 2. The hoisting ropes run around the traction sheave 4 of the hoisting machine. The traction sheave is driven by a hoisting motor 5. The rotation of the traction sheave is monitored by means of a tachometer 6, which is placed on the shaft 7 rotated by the hoisting motor. The elevator serves a number of landings 8. In conjunction with the landings there are position reference points consisting of magnets 9, each landing being preferably provided with one. Placed in the elevator car is a linear transducer type sensor 10 which produces a signal dependent on the relative positions of the sensor and magnet with respect to each other. The sensor and magnet are so placed in relation to each other and to the elevator car and landing that a linear signal is obtained when the car sill and landing sill are within a given distance window with respect to each other. In conjunction with the traction sheave 4 there is a brake surface 11 for the brake shoe 12 of the operating brake of the elevator.

Figure 2:
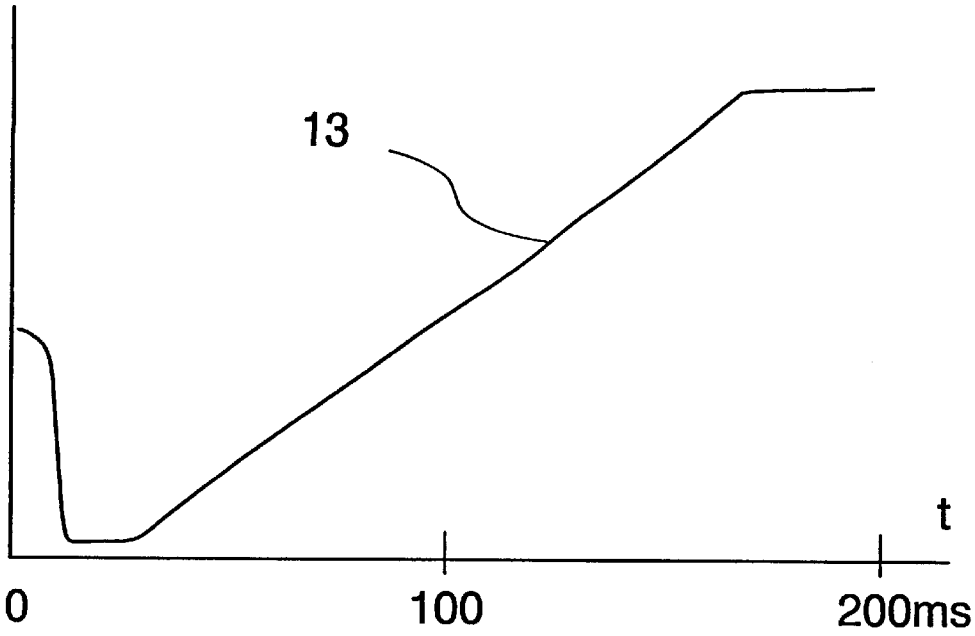
FIG. 2 presents the signal given by a linear transducer type sensor.

FIG. 2 shows the signal 13 given by a typical, linear transducer type sensor placed in the elevator car when the elevator is travelling at a constant speed past a floor. The signal obtained is presented as, a function of time. Thus, the position of the elevator car moving in the elevator shaft in relation to the landing, is measured using a sensor which is placed in the elevator car and gives a position signal proportional to the height difference between the landing and the floor of the elevator car. Using the position signal, it is possible to generate a reference for controlling the hoisting motor at and near the landing. Even if the position signal obtained from the linear sensor were converted by means of an analog-to-digital converter into a form usable for a digital controller, the converted signal would be substantially continuous as regards the elevator's motional characteristics and their adjustment. For example, using 10-bit conversion with a sensor of a length of 150 mm, a position resolution of about 0.15 mm will be achieved. Such a position resolution means that even though the signal in its converted form actually changes in a stepwise manner, it is practically a continuously changing signal as regards position adjustment.

Figure 3:
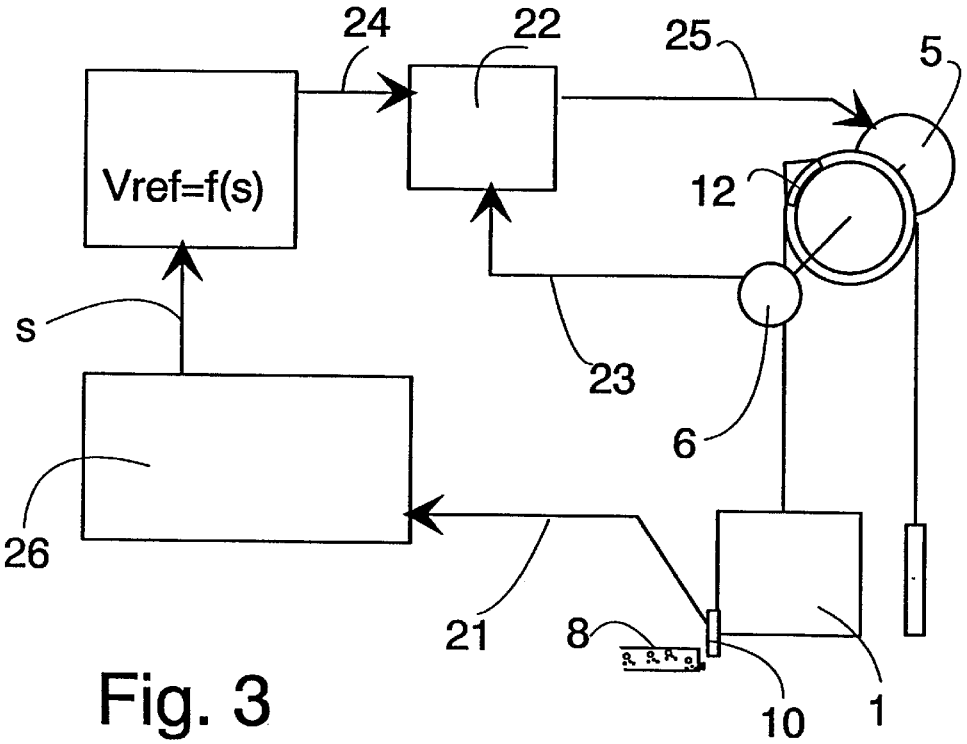
FIG. 3 presents an embodiment of the invention in the form of a simple block diagram.

FIG. 3 presents an embodiment of the invention as a simple block diagram. When the elevator is starting to move, the distance data 21 provided by the linear sensor 10 is being read and used by the motor control system to produce a speed reference, in other words, the position of the car 1 relative to the landing 8 is being monitored directly. The output put 25 of a PI-controller-servo-unit 22, i.e. the motor drive, is adjusted on the basis of the tachometer signal 23 and the speed reference 24. In a distance feedback signal scaling unit 26, the distance data 21 is scaled to form a signal s suited for the generation of a speed reference. This signal s is a variable in the function $V_{ref}=f(s)$, whose momentary value is the momentary speed reference. During the start, the use of a distance signal 21 as an aid to form a speed reference 24 has the effect that, when e.g. the distance to the landing begins to increase from zero in the positive direction, the motor 5 is supplied a speed reference that forces the car back to its former position. Therefore, the larger the positive distance from the landing, the larger the negative speed reference to be supplied to the motor drive. At the same time, the brake 12 is released. The brake is preferably a slow-release type brake, in other words, it takes longer for the brake to be released than the time that would elapse before the occurrence of a change in the feedback data when the elevator is starting to move. Once the brake 12 has been released, the elevator can be driven with the normal speed reference using a DC tachometer or the like to provide speed feedback. The signal s obtained by scaling from the distance data 21 is used for start adjustment when the brake is being released. After the brake has been released, the elevator is set in motion and is driven on the basis of a speed reference generated in the conventional manner.

Figure 4:
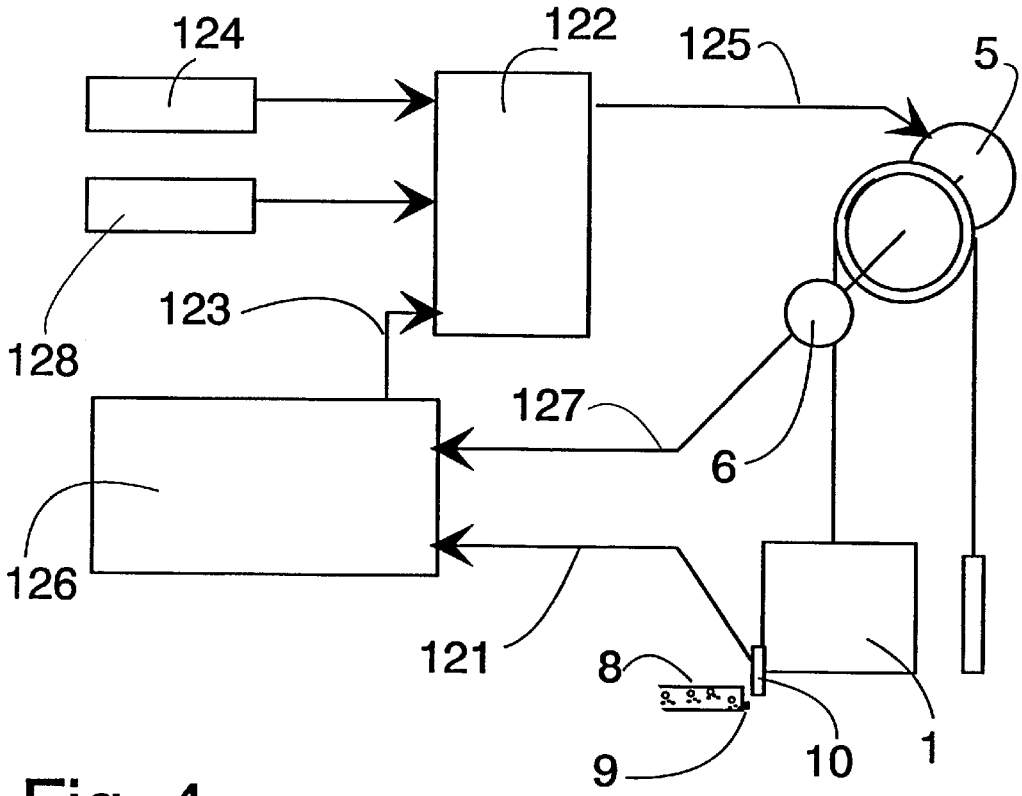
FIG. 4 presents a block diagram of another embodiment of the invention.

FIG. 4 presents another embodiment of the invention in the form of a simple block diagram. In this embodiment, the one of different feedback signals is selected that is best suited for the motional condition and position of the elevator. The feedback selection is made by a feedback selection and scaling unit 126, which selects either the tachometer signal 127 or the linear sensor signal 121 for use as feedback signal 123. Depending on the feedback signal selection, a decision is made as to whether the motor is to be controlled primarily on the basis of position control or speed control, thereby also selecting whether the elevator is to be driven on the basis of the position reference 128 or the speed reference 124. An advantageous method is to change from position feedback to speed feedback after the elevator has advanced through a preset distance from the starting level or after a preset length of time has elapsed. The decision can also be made on other grounds. On arrival to the destination floor, the change from speed feedback to position feedback can be effected e.g. after it has been established from the tachometer signal that the elevator car is at such a distance from the landing that the linear sensor will produce a linear signal. The selection and scaling unit 126 also takes care of adapting the signal to the motor control circuit as required. The tachometer 6 gives a signal 127 proportional to the speed of the hoisting motor, which is used as feedback signal during most of the passage of the elevator car 1 from the starting floor to the destination floor.

When the elevator is leaving a floor, the distance data 121 relating to the elevator car 1 as provided by the linear sensor 10 is being read, to be utilized as feedback in motor control. When the elevator is leaving, the output 125 of the PI-controller-servo-unit 122 of the motor control system is adjusted to effect position control on the basis of the position reference 128 and the selected feedback signal 123 based on the distance data 121. When the elevator is starting, the following occurs. The position controller compares the position data based on the linear sensor signal to the position reference and, based on the difference between the position reference and the position data, outputs a torque reference to the motor. At departure, a zero position reference is applied at first until the brake is released. Feedback is obtained from the linear sensor. After this, the system begins to change the position reference so that the elevator car will move with a preset acceleration and change of acceleration. The motion of the motor shaft may differ from the corresponding elevator car movement, but during the start, smooth and jerk-free movement of the car is important. After the elevator has been set in motion, at a preset point or when the end of the range of the linear sensor is reached, the system switches from position adjustment control to speed adjustment control. The feedback signal is now taken from the tachometer. For this change, the integral term for position control is transferred to the integral term for speed control and the initial value of the speed reference is set to the prevailing speed value measured from the motor shaft by the tachometer.

Figure 5:
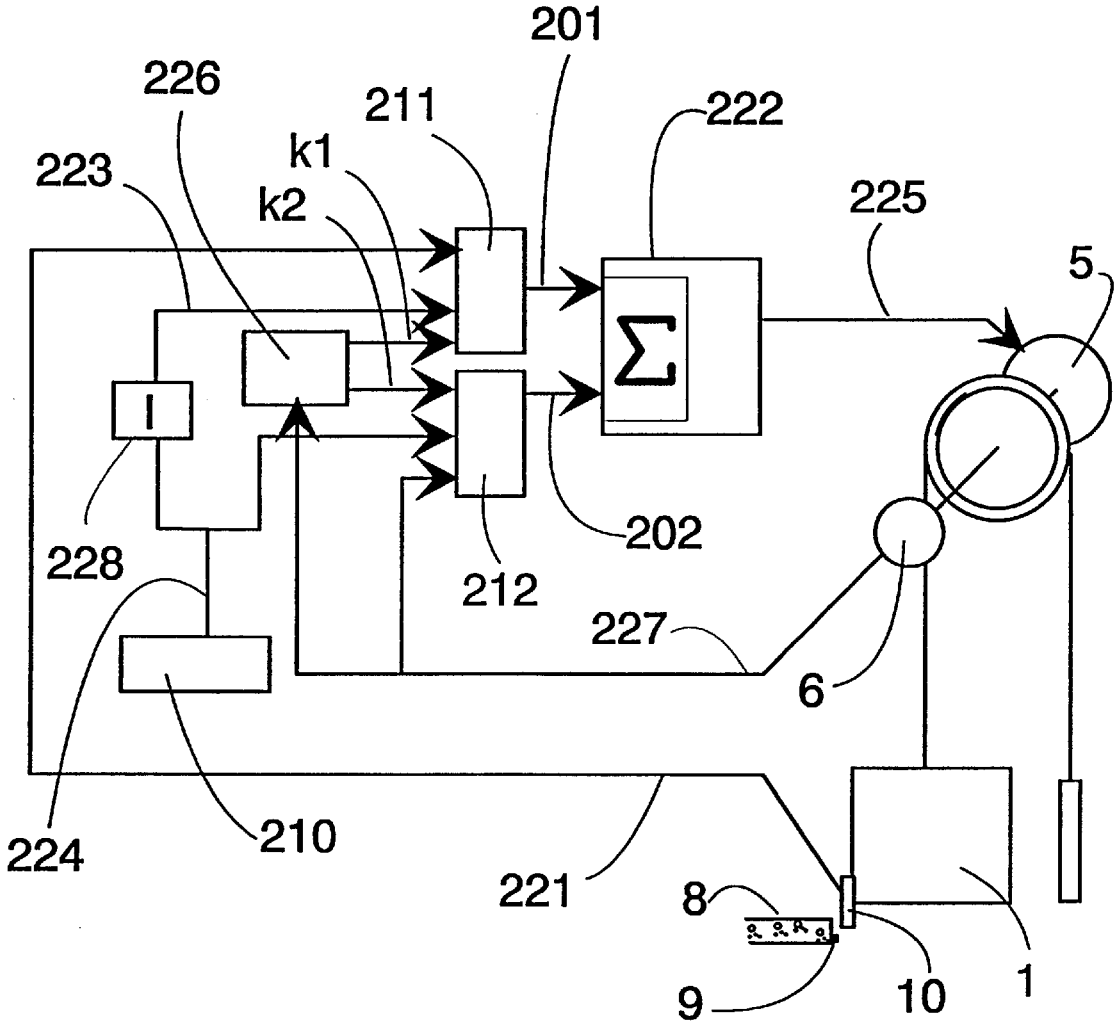
FIG. 5 presents a block diagram of yet another embodiment of the invention.

The block diagram in FIG. 5 presents a different embodiment of the invention. The motor control output 225 is generated in a drive unit 222. The drive unit is controlled by references 202 and 201 based on speed and position. The drive unit 222 is controlled either by using reference 202 or reference 201 or the combined effect of references 202 and 201, depending on the position and motional condition of the elevator car. The reference 202 based on speed is generated by a speed controller 212 and the reference based on position is generated in a position controller 211. The speed signal 227 obtained from the tachometer 6 is fed back to the speed controller 212 and the position signal 221 obtained from the linear sensor 10 is fed back to the position controller 211. The speed controller 212 is controlled by means of a speed reference 224 stored in memory 210 or generated separately. Via integration, an integrating unit 228 produces a position reference 223 from the speed reference, which is used to control the position controller 211. The speed signal 227 is used to control the generation of relative weighting factors k1 and k2 for position control and speed control. The weighting of position control and speed control is effected as follows. When the elevator car stands still at a landing 8, the weighting factor k1 for position control is 1 and the weighting factor k2 for speed control is 0. When the elevator speed increases from zero to a preset limit, the weighting factors change from the value of 1 to the value of 0 and from the value of 0 to the value of 1. At the start of a run, the preset limit speed is always reached before the elevator car has advanced past the point to which the linear range of the linear sensor extends. The weighting 226 is controlled by the speed signal 227 obtained from the tachometer. The sum of the weighting factor k1 for position control and the weighting factor k2 for speed control equals 1. Preferably k1 is reduced and k2 is increased in a stepless manner as the speed changes from zero to the preset limit speed. For speeds exceeding the preset limit, k1=0 and k2=1.

When the elevator car is between floors outside the linearly position-dependent range of the linear sensor signal 13, the movement of the elevator car is controlled exclusively via speed regulation, even when the speed is low.

Figure 6:
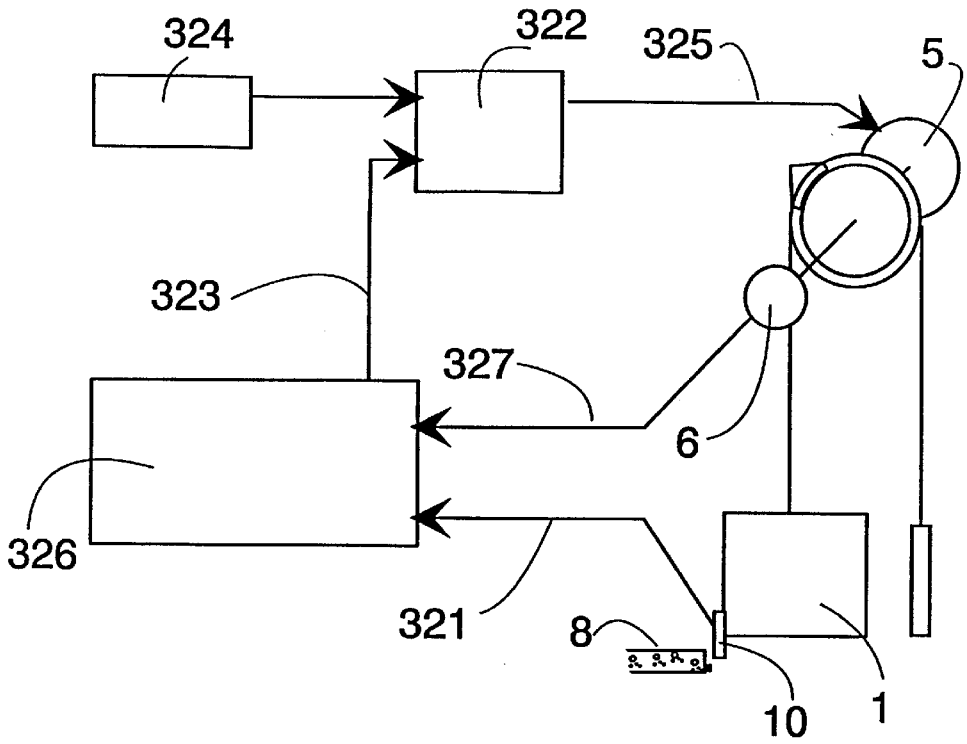
FIG. 6 presents a further embodiment of the invention as a simple block diagram.

FIG. 6 presents a simple block diagram of a further embodiment of the invention. In this embodiment, the one of the speed feedback signals that best suits the elevator's motional condition and position is selected. The feedback selection is made by a feedback selection and scaling unit 326, which selects either the tachometer signal 327 or the linear sensor signal 321 for use as feedback signal 323. When the elevator is departing from a floor, the decision to change from position feedback to speed feedback can be made e.g. after a preset distance from the starting floor has been reached or a preset length of time from the starting moment has elapsed. On arrival to the destination floor, the change from speed feedback to position feedback can be effected e.g. after it has been established from the tachometer signal that the elevator car is at such a distance from the landing that the linear sensor will produce a linear signal.

The selection and scaling unit 326 also takes care of adapting the signal to the motor control circuit as required. The tachometer 6 produces a signal 327 proportional to the speed of the hoisting motor, which is used as feedback signal during most of the passage of the elevator car 1 from the starting floor to the destination floor. When the elevator is leaving a floor or stopping, the distance data 321 relating to the elevator car 1 as provided by the linear sensor 10 is being read, to be utilized as feedback in motor control.

At each landing 8, the distance travelled by the car 1 can be accurately read by means of the linear sensor 10. As the time it took for the car to move through this distance is also known, being given by the number of speed adjustment periods, the car speed can be calculated. As this speed is suitably scaled and used as feedback in the speed controller, i.e. as feedback in the PI-controller-servo-unit 322 of the motor control system, the output 325 of the PI-controller-servo-unit 322 is adjusted on the basis of the selected feedback signal 323 and the speed reference 324.

It is obvious to a person skilled in the art that the embodiments of the invention are not restricted to the examples described above, but that they may instead be varied in the scope of the claims presented below. For instance, the arrangement used for distance measurement at a landing may be based on other methods, e.g. the use of an optic position sensor, instead of the detection of a magnetic field. It is further obvious to the skilled person that the motor drive may be formed in a different way. It is also obvious that, although the examples presented primarily describe the invention with respect to departure of an elevator from a floor, the invention is also applicable for the control of stopping at a floor.

What is claimed is:

1. A method for controlling a hoisting motor in an elevator having plural landings comprising:

generating a motor drive output by using a speed reference and an angular speed signal and/or angle signal proportional to the rotation of the hoisting motor as a feedback signal;

measuring the position of an elevator car in relation to a landing using a sensor placed on the elevator car and fitted to produce a substantially continuous position signal proportional to separation between the landing and the elevator car; and using said position signal as a reference in controlling torque supplied by the hoisting motor during initial movement of the elevator car away from the landing.

2. The method according to claim 1, wherein:

when the elevator car is departing from a landing or stopping at a landing, a position reference is used in generation of the motor drive output when the elevator car is at or close to the landing, and feedback for control of the hoisting motor is obtained from the speed signal when the speed reference is used and from the position signal when the position reference is used.

3. The method according to claim 2, wherein choice between control based on position reference and control based on speed reference is changed on the basis of distance of the elevator car from the landing.

4. The method according to claim 2, wherein choice between control based on position reference and control based on speed reference is changed on the basis of speed of the elevator car.

5. The method according to claim 2, wherein control of the hoisting motor is changed from control based on position reference to control based on speed reference both via position reference based control and via speed reference based control.

6. The method according to claim 1, wherein when the elevator car is departing from a landing or stopping at a landing, a reference for the control of the hoisting motor is generated with aid of the position signal, the position signal being a continuous and continuously changing signal.

7. The method according to claim 1, wherein the position signal is used as a feedback signal in control of the hoisting motor.

8. The method according to claim 7, wherein the position signal is selected to be used as a feedback signal when the elevator car is moving at a low speed near a landing while otherwise the speed signal is selected.

9. The method according to claim 1, wherein the position signal is utilized to generate a speed reference.

10. An apparatus for controlling a hoisting motor in an elevator having a number of landings comprising:

a control circuit developing a motor drive output by using a speed reference and an angular speed signal and/or angle signal proportional to the rotation of the hoisting motor as a feedback signal; and a position reference generator generating a position reference, said position reference generator including, a position reference point provided in an elevator shaft and immovably attached with respect to a landing, and a sensor provided on an elevator car for measuring the position of the elevator car relative to the position reference point, said sensor being fitted to substantially continuously produce a position signal proportional to separation between the landing and a floor of the elevator car, said control circuit using the position signal to control the torque supplied by the hoisting motor during initial movement of the elevator car away from the landing.

11. An apparatus according to claim 10, wherein a position reference point is provided at each landing, the control circuit controlling the motor drive output on the basis of the position reference when the elevator car is at or near a landing, the control circuit obtaining feedback from the speed signal when the speed reference is used and from the position signal when the position reference is used.

12. An apparatus according to claim 10, wherein a position reference point is provided at each landing.

13. An apparatus according to claim 10, wherein the position signal is used by the control circuit as the feedback signal in the control of the hoisting motor.

14. An apparatus according to claim 13, wherein the apparatus comprises a unit fitted to select either the speed signal or the position signal for use as feedback signal.

15. An apparatus according to claim 10, wherein the speed signal is formed as a function from the position signal.

16. An apparatus according to claim 11, wherein the apparatus comprises a unit selecting either the speed signal or the position signal for use as a feedback signal and selecting either the speed reference or the position reference for use as a reference.

17. An apparatus according claim 11, wherein said control circuit includes a position controller using position feedback and a speed controller using speed feedback and a unit fitted to give a weighting to relative effect of the position controller and the speed controller.

18. An apparatus according to claim 10, wherein the control circuit treats the position signal as a continuous and continuously changing signal.

19. A method of smoothly accelerating an elevator from a landing comprising:

a) providing a positional reference signal representative of the elevators actual position with respect to a landing;

b) supplying a motor drive voltage to the elevator motor to drive the elevator motor; and c) during initial acceleration of said elevator away from a landing, modifying the motor drive voltage supplied in said step b) based on the positional reference provided in said step a) to smooth the acceleration of said elevator.

20. An elevator motor control system for controlling the drive of the elevator motor to drive said elevator between floors, said control system comprising:

a motor control for supplying a voltage to the elevator motor to drive the motor between floors;

a tachometer measuring the rotational speed of said elevator motor;

a reference generator for supplying a velocity reference to said motor control;

a linear sensor for monitoring the position of the elevator in proximity of a landing and producing distance data related thereto; and a speed reference modifying circuit for modifying said speed reference in response to said distance data, said speed modifying circuit varying said velocity reference supplied to said motor control by said reference generator during initial movement the elevator away from said landing to smooth the initial acceleration of said elevator away from said landing.

21. An elevator motor control system for controlling the drive of the elevator motor to drive said elevator between floors, said control system comprising:

a motor control for supplying a voltage to the elevator motor to drive the motor between floors;

a tachometer measuring the rotational speed of said elevator motor;

a position sensor for monitoring the position of the elevator in proximity of a landing and producing distance data related thereto;

a reference generator for supplying a velocity reference to said motor control; and a feedback selection and scaling unit, operatively connected to said tachometer and position sensor, for selecting and supplying feedback from said tachometer and position sensor to the motor control, said feedback selection and scaling unit switching from positional to velocity feedback as the elevator accelerates from a landing to smooth the initial acceleration of said elevator.

22. The motor control system of claim 21 wherein said feedback selection and scaling unit gradually switches the feedback from the position sensor as the elevator leaves a landing to velocity feedback.

23. The motor control of claim 21 further comprising a slow release brake for preventing rotation of said motor while said elevator is parked at a landing, the speed of release of said brake being slower than the time needed to change the feedback output from said feedback selection and scaling unit to control the motor torque.

24. The motor control of claim 21 wherein said position sensor senses the position of said elevator car and said tachometer senses the rotation of said motor.

25. An elevator motor control system for controlling the drive of the elevator motor to drive said elevator between floors, said control system comprising:

a motor control for supplying a voltage to the elevator motor to drive the motor between floors;

a tachometer measuring the rotational speed of said elevator motor;

a position sensor for monitoring the position of the elevator in proximity of a landing and producing distance data related thereto;

a speed control circuit responsive to said tachometer for controlling said motor based on speed control;

a position control circuit responsive to said position sensor for controlling said motor based on position control; and a drive circuit receiving the output of said speed control circuit and said position control circuit and switching from positional to velocity feedback as the elevator initially moves away from a landing to smooth the initial acceleration of said elevator.

26. An elevator motor control system for controlling the drive of the elevator motor to drive said elevator between floors, said control system comprising:

a motor control for supplying a voltage to the elevator motor to drive the motor between floors;

a tachometer measuring the rotational speed of said elevator motor;

a position sensor for monitoring the position of the elevator in proximity of a landing and producing distance data related thereto;

a speed control circuit responsive to said tachometer for controlling said motor based on speed control;

a position control circuit responsive to said position sensor for controlling said motor based on position control; and a drive circuit receiving the output of said speed control circuit and said position control circuit and switching from positional to velocity feedback as the elevator is released from a landing to smooth the initial acceleration of said elevator, wherein said drive circuit performs a weighted summing of the output of said speed control circuit and said position control circuit to gradually switch from position control to velocity control as the elevator is accelerated by said motor.

27. A method for controlling a hoisting motor in an elevator having plural landings comprising:

generating a motor drive output by using a speed reference and an angular speed signal and/or angle signal proportional to the rotation of the hoisting motor as a feedback signal;

measuring the position of an elevator car in relation to a landing using a sensor placed on the elevator car and fitted to produce a substantially continuous position signal proportional to the height difference between the landing and the floor of the elevator car; and using said position signal as a reference to control the torque supplied by the hoisting motor as the elevator car departs from the landing, wherein said position signal is used as a feedback signal during acceleration of said elevator away from said landing.

28. A method for controlling a hoisting motor in an elevator having plural landings comprising:

generating a motor drive output by using a speed reference and an angular speed signal and/or angle signal proportional to the rotation of the hoisting motor as a feedback signal;

measuring the position of an elevator car in relation to a landing using a sensor placed on the elevator car and fitted to produce a substantially continuous position signal proportional to the height difference between the landing and the floor of the elevator car; and using said position signal as a reference to control the torque supplied by the hoisting motor as the elevator car departs from the landing, wherein said control circuit uses the position signal produced by said sensor as a feedback signal during acceleration of said elevator away from said landing.

* * * * *